US006759087B1

(12) United States Patent
Reuscher

(10) Patent No.: US 6,759,087 B1
(45) Date of Patent: Jul. 6, 2004

(54) SOLUTION FOR SEALING POROUS METAL SUBSTRATES AND PROCESS OF APPLYING THE SOLUTION

(75) Inventor: Craig J. Reuscher, Chicago, IL (US)

(73) Assignee: Conspectus, Inc., Chicago, IL (US)

( * ) Notice: Subject to any disclaimer, the term of this patent is extended or adjusted under 35 U.S.C. 154(b) by 168 days.

(21) Appl. No.: 10/120,053

(22) Filed: Apr. 10, 2002

(51) Int. Cl.[7] ..... B05D 5/00; B05D 7/14

(52) U.S. Cl. ..... 427/240; 427/295; 427/327; 427/344; 427/346; 427/348; 427/354; 427/397.8; 427/427; 427/435

(58) Field of Search ..... 427/240, 295, 427/343, 344, 346, 348, 354, 397.8, 430.1, 435, 327, 427

(56) References Cited

U.S. PATENT DOCUMENTS 4,368,107 A 1/1983 Maejima et al. ..... 204/24
4,508,681 A 4/1985 Bodden et al. ..... 419/29
4,698,269 A 10/1987 Narusch, Jr. et al. ..... 428/552
4,717,422 A 1/1988 Perfetti
5,085,897 A 2/1992 Luckanuck
5,205,874 A 4/1993 Crews, IV et al. ..... 148/254
5,672,390 A 9/1997 Crews, IV et al. ..... 427/309
5,700,523 A 12/1997 Petrole et al.
5,888,280 A 3/1999 Montes ..... 106/14.21
6,206,982 B1 3/2001 Hughes et al.
6,287,372 B1 9/2001 Briand et al. ..... 106/14.05
6,358,616 B1 3/2002 Jennings

*Primary Examiner*—Michael Barr
*Assistant Examiner*—Kirsten Crockford Jolley
(74) *Attorney, Agent, or Firm*—Lloyd L. Zickert

(57) ABSTRACT

An aqueous inorganic solution for sealing the porosity of metal components made of sintered compacted powered metal and castings formed from liquid metal, and a process for applying the solution onto the components. The solution consists primarily of a blend of inorganic metallic salt silicates with the metal ions being taken from Group 1A elements.

16 Claims, 1 Drawing Sheet

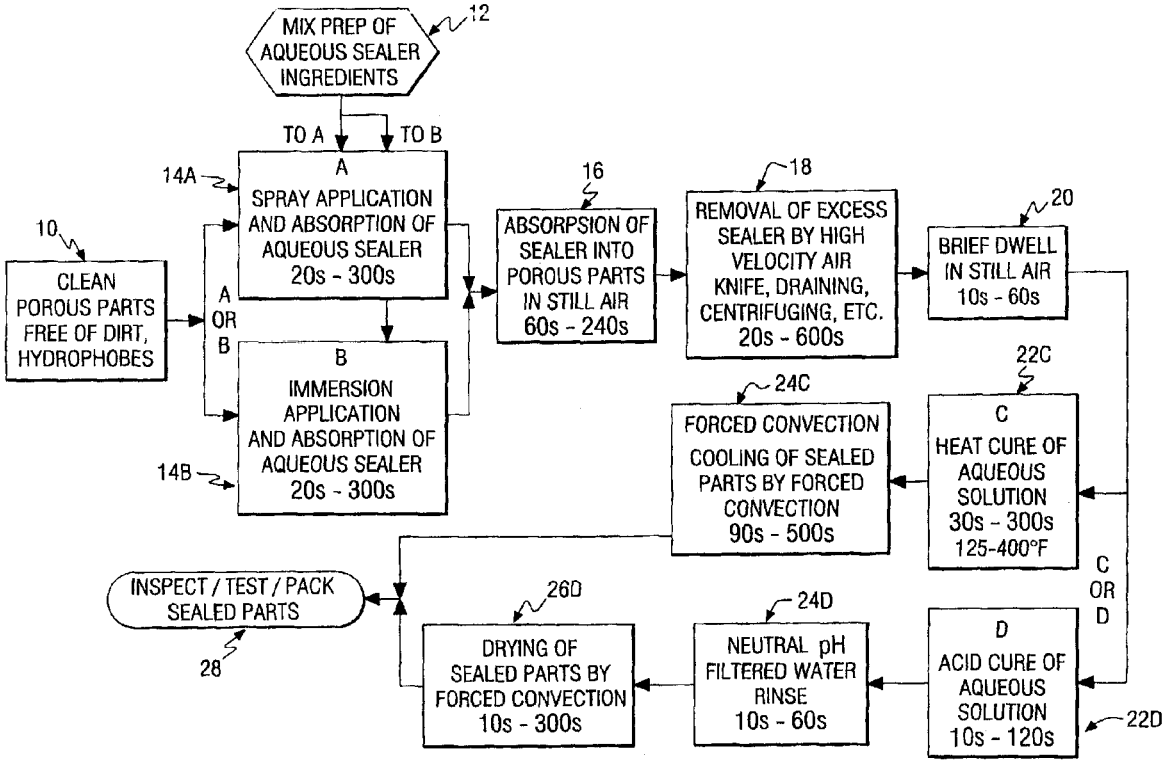

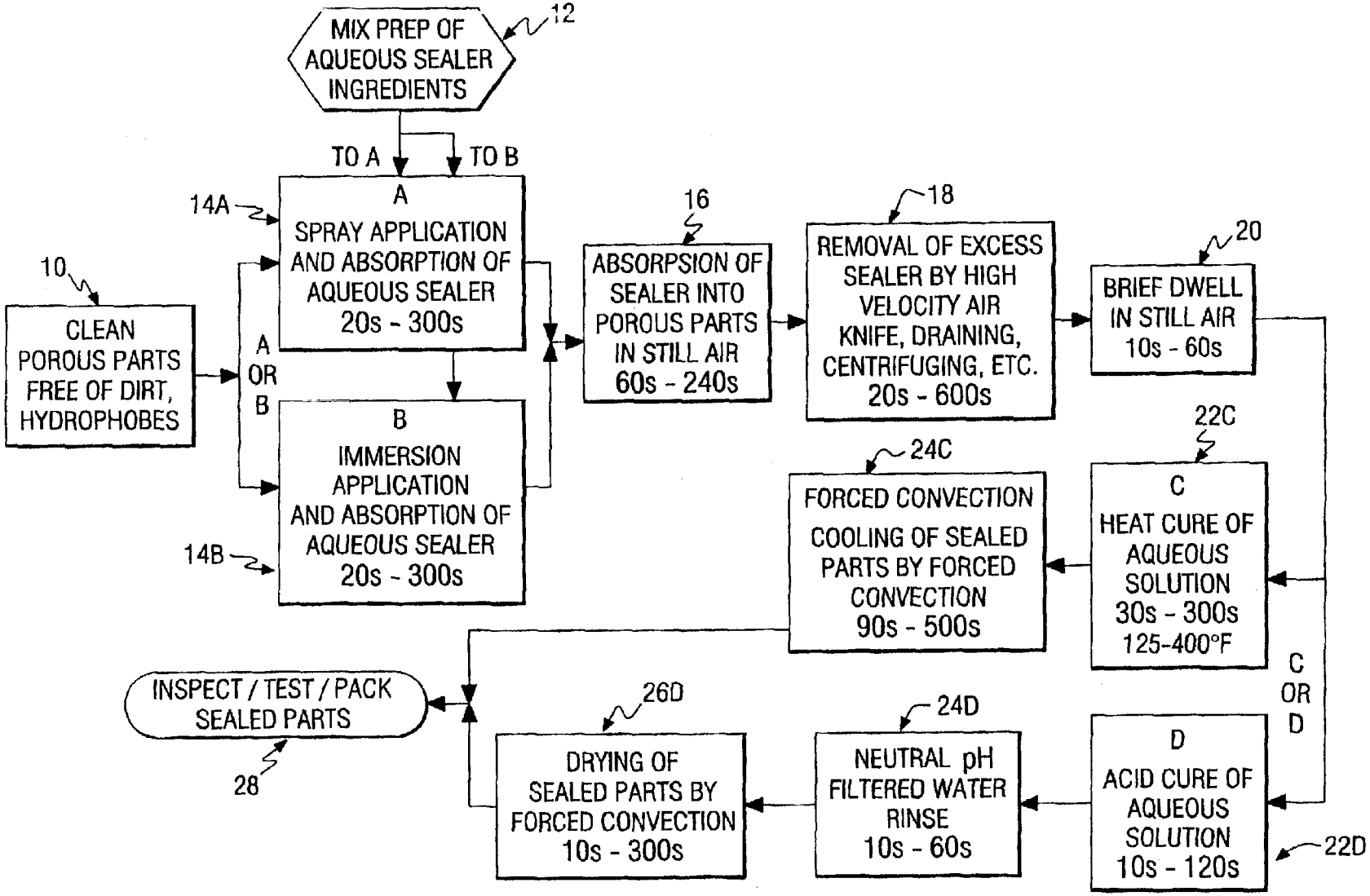
MIX PREP OF AQUEOUS SEALER INGREDIENTS
12
TO A
TO B
A
SPRAY APPLICATION AND ABSORPTION OF AQUEOUS SEALER 20s - 300s
B
IMMERSION APPLICATION AND ABSORPTION OF AQUEOUS SEALER 20s - 300s
14A
14B
A OR B
CLEAN POROUS PARTS FREE OF DIRT, HYDROPHOBES
10
ABSORPSION OF SEALER INTO POROUS PARTS IN STILL AIR 60s - 240s
16
REMOVAL OF EXCESS SEALER BY HIGH VELOCITY AIR KNIFE, DRAINING, CENTRIFUGING, ETC. 20s - 600s
18
BRIEF DWELL IN STILL AIR 10s - 60s
20
C
HEAT CURE OF AQUEOUS SOLUTION 30s - 300s 125-400°F
22C
FORCED CONVECTION COOLING OF SEALED PARTS BY FORCED CONVECTION 90s - 500s
24C
C OR D
D
ACID CURE OF AQUEOUS SOLUTION 10s - 120s
22D
NEUTRAL pH FILTERED WATER RINSE 10s - 60s
24D
DRYING OF SEALED PARTS BY FORCED CONVECTION 10s - 300s
26D
INSPECT / TEST / PACK SEALED PARTS
28

SOLUTION FOR SEALING POROUS METAL SUBSTRATES AND PROCESS OF APPLYING THE SOLUTION

This invention relates in general to an aqueous inorganic solution for sealing the porosity of metal components prior to the application of functional surface treatments or performance coatings or machining, and more particularly to an aqueous sealing solution of metallic silicates for sealing the porosity of powdered metal and liquid metal cast components, as well as a process for applying the solution to the substrates of the components so as to mitigate the negative efforts of porosity on functional surface treatments, corrosion resistance, and machineability.

BACKGROUND OF THE INVENTION

The process of manufacturing components of sintered compacted powdered metal traces its roots to a similar process used to fabricate structural carbon components. The process consists of molding metal powder in a die with movable top and bottom punches under tons of mechanically or hydraulically applied pressure to form a part which after being removed from the die cavity is then sintered in an oven at a temperature just below that of the melting point of the metal or alloy powder used in the process. The sintered component thus formed has the shape of the cavity of the die. Such sintered components have appreciable strength dependent upon many factors including the metal powder or powdered alloy used in the process, the density of compaction during the application of pressure to the die, and the sintering temperature. Powdered metal components with increasingly intricate designs are utilized in a broad spectrum of industries including, but not limited to, automotive, heavy truck, lawn and garden equipment, household appliances, power tools, and mechanical power transmission equipment. An advantage of sintered powdered metal parts is that they yield a part with intricate detail requiring little or, at the most, no machining. The cost of such parts is extremely competitive as compared to the same part that may be machined from billet metal.

The most significant disadvantages of powdered metal parts over a machined wrought part include having a porosity that reduces density and results in slightly lower strength and negatively affects secondary machining. Moreover, the porosity negatively affects the application of functional surface treatments including painting, electroplating, electrocoating, performance coating, and the like. Liquid plating solutions and coating materials applied to the substrates of powdered metal parts can form bubbles, blisters, flakes, pinholes, and the like, during thermal curing. Because of these results, the aesthetic appearance of the parts is mostly unacceptable. Further, powdered metal parts have a tendency to develop red oxide or rust in a short period of time unless protected by oil impregnation, phosphate conversion, electroplating, electrocoating, painting, performance coating, or the formation of blue oxide by the steam-treating process.

The intrinsic porosity of a powdered metal part particularly at the surface will cause absorption of phosphate conversion solutions, electroplating solutions, electrocoating baths, and dip or spray applied paints and performance coatings. This absorption makes it extremely difficult to obtain the desired film thickness of later applied functional surface treatments and particularly those thermosetting finishes that require heat for curing as the absorbed wet functional surface treatments will be driven out forming bubbles, blisters, flaking, and other undesirable discontinuities in the surface film.

Heretofore, there have been porosity reducing processes for powdered metal parts manufacturers as well as job shop platers and coaters. One such process includes the vacuum impregnation of the porous surface with a polymer resin either of a heat-curing or anaerobic-curing type. Another porosity reducing process heretofore known is to peen the surface of the part with grit or shot-blasting that results in some degree of porosity reduction. It has also been known to steam treat the surface of powdered metal parts wherein the parts are first heated in a furnace to reach a specific temperature range, and then subjected to super-heated steam which permeates the surface of the parts and forms "blue iron oxide" that fills the interstitial voids between the agglomerated metal powdered particles. Each of these processes has its own drawbacks, chief among them being cost.

Resin impregnation is typically the most costly of the above processes and can leave a resin residue on the surfaces that can interfere with subsequent plating and coating adhesion and appearance. Moreover, the polymer resin is temperature limited to approximately 450 degrees F. or less, which is below the cure temperature of a number of performance coatings, thereby preventing the process from being used where such performance coatings are required.

While grit or shot-blasting is effective in some cases at reducing porosity sufficiently to allow application of performance surface treatments, the design features and shapes of more intricate powdered metal components may be so modified that the surface characteristics or part dimensions become altered and unacceptable to design requirements. In this regard the blast media (grit or shot) may become lodged in threads or blind holes on the surfaces of the parts.

While the steam treating process may be effective in sealing porosity of powdered metal parts, the temperature range used in the process can "draw" hardness and impart a degree of brittleness to the surface of the part. Because of this result, steam treating for reducing porosity is avoided where secondary machining of the parts is required. Moreover, the formation of oxide from steam treating can affect the parts dimensionally by making outside diameters larger and inside diameters smaller which can also result in non-conforming parts and resultant scrap cost.

Many of the above porosity problems similarly exist with parts made from casting of liquid iron, steel, aluminum, titanium, magnesium, copper, brass, bronze, zinc, and their alloys, as well as other castable metals and their alloys.

Heretofore, it has been known to treat the surface of porous metallic parts by the process of using aqueous metallic salt solutions applied electrolytically as carriers for the metallic sulfides, as disclosed in U.S. Pat. No. 4,368,107. Such an electrolysis process can lead to hydrogen embrittlement in high-carbon alloy substrates and is therefore undesirable.

U.S. Pat. No. 4,508,681 teaches the application of an alkali metal silicate to a sintered metal substrate in conjunction with conventional heat induced hardening for the advantage of promoting surface sealing and limiting hardening by conventional heat treating operations by blocking the entry into the surface of the part of oxygen, nitrogen or carbon. It is not the objective of teaching in this patent to provide for significant reduction of porosity because it is stated that while only the surface is sealed and hardened internal porosity of the substrate is desired for subsequent intake of lubricants for using the part as a bearing in machinery.

U.S. Pat. No. 4,698,269 teaches porosity sealing of a sintered iron component when treating the component with a solvent carried phosphorizing compound and thereafter applying a chromium containing coating composition. While this process does reduce porosity, it is not as cost-effective as resin impregnation, steam treating and grit or shot blasting. Moreover, the phosphorizing process may not lend itself to subsequent plating and coating operations where acids or electrolysis is employed and the solvent used poses environmental concerns.

Applications of Group 1A metallic silicates are taught in U.S. Pat. Nos. 5,205,874 and 5,672,390 as being useful in protecting wood or metal surfaces from abrasion, corrosion, heat and fire by the formation on the surface of an inorganic insoluble silicon dioxide film. This patent is not concerned with the surface treatment of porous substrates for the purpose of porosity reduction.

It has long been well known to use Group 1A alkali silicates (lithium, sodium, potassium) as binders in coatings containing a variety of fillers. U.S. Pat. Nos. 5,888,280 and 6,287,372 relate to coatings that include a variety of metallic and non-metallic functional pigments.

SUMMARY OF THE INVENTION

The aqueous inorganic solution of the present invention and the process for applying the solution to sintered powdered metal parts or castings formed from liquid metal reduces and seals the porosities of these parts, while negligibly affecting the dimensions of the parts and not altering the metallurgical or strength properties of the parts. Accordingly, the presents invention solves the problems heretofore known in the technology of preparing powdered metal and liquid cast parts for efficiently receiving subsequent coatings that become more effective.

Moreover, the porosity reducing solution and method of application according to the present invention essentially eliminates the "bleed" or "outgassing" of absorbed materials during subsequent plating, coating and machining operations. Further, the solution of the present invention and the process of applying the solution according to the invention permits the application of functional surface treatments in the required thickness without significantly modifying the surface where applied, while improving corrosion protection and machineability and preparing the surface for application of functional plating or coating. It will be further appreciated that the aqueous inorganic solution and method of application according to the present invention is cost-advantageous in that the porosity can be reduced in a timely and economical manner, while being environmentally compliant. The aqueous inorganic solution of the present invention utilizes low cost raw materials that may be combined by simple blending and applied and cured through unique combinations of existing application technologies.

It is therefore an object of the present invention to provide a new and improved aqueous inorganic solution for reducing the porosity of sintered powdered metal parts and cast liquid metal parts so that subsequent coatings can be more effective, and wherein the solution is formulated through the use of low cost raw materials and may be applied by existing application technologies.

Another object of the present invention is to provide an aqueous inorganic solution made from a blend of metallic salt silicates with metal ions taken from Group 1A elements, and a process for applying the solution to sintered powdered metal or liquid cast metal parts that is environmentally compliant and poses no health, safety or environmental hazards to users.

Another object of the present invention is in the provision of an aqueous inorganic solution for application to porous metal parts to reduce porosity that will improve corrosion protection and machineability and prepare the surface for efficient subsequent application of functional plating and coatings.

A still further object of the present invention is in the provision of an aqueous inorganic solution and a process for application of the solution to sintered powdered metal or liquid cast parts for reducing porosity in a cost-advantageous manner, while negligibly changing the dimensions of the parts and not changing the metallurgical or strength properties.

Other objects, features and advantages of the invention will be apparent from the following detailed disclosure, taken in conjunction with the accompanying sheet of drawings, wherein like reference numerals refer to like parts.

DESCRIPTION OF THE DRAWINGS

It The single FIGURE is a diagrammatic process flow diagram of the application process according to the present invention.

DESCRIPTION OF THE INVENTION

The present invention relates to reducing or sealing the porosity of metal parts made of sintered powdered metal or castings formed from liquid metal by application of a unique aqueous solution blended of inorganic metallic salt silicates with the metal ions being taken from Group 1A elements, and the process for applying the solution so that subsequent application of functional or performance surface treatments are materially more effective, as well as the machineability of the parts.

The preferred composition of the aqueous sealing solution according to the present invention is a blend of approximately 5 to 50 parts 2.00 weight ratio aqueous sodium silicate solution, 5 to 50 parts 3.22 weight ratio aqueous sodium silicate solution, and 20 to 90 parts 2.50 weight ratio aqueous potassium silicate solution. Preferably, the solutions are blended by low shear mixing. Being most preferred is 36 parts 2.00 weight ratio aqueous sodium silicate solution, 24 parts 3.22 weight ratio aqueous sodium silicate solution, and 40 parts 2.50 weight ratio aqueous potassium silicate solution blended by low shear mixing. All specified quantities are parts per hundred by weight.

Potassium silicate alone is not preferred as a sealer since it tends not to form a continuous glass-like film, rather, the dried potassium silicate film is somewhat granular and discontinuous. Sodium silicate alone is not preferred as a sealer because its film tends to be too continuous and glass-like, which can interfere with subsequent application of functional surface treatments or machining. In addition, a sealer made entirely of sodium silicate will tend to form in varying degrees a whitish-opaque carbonate deposit or "bloom" when treated with exposure to air and humidity.

The sodium/potassium silicate blend can be modified by inclusion of from 0.5 parts to parts of 10.0 weight ratio lithium silicate/silica sol, most preferably 5 parts to 7 parts of said lithium silicate/silica sol. The lithium silicate provides for ambient temperature cure of the aqueous silicate blend by promoting a reaction during water evaporation that makes the remaining sodium/potassium/lithium silicate blend insoluble. Calcium silicate can be substituted for the lithium silicate/silica sol, providing a similar insolubilizing/curing effect, but lithium is preferred due to longer pot life stability.

The neat sodium/potassium silicate blend or the neat sodium/potassium/lithium silicate blend is further modified by dilution with filtered and preferably deionized water to facilitate penetration into the porous substrate. The dilution can range from 10% of the neat solution weight to as much as 250% of the net solution weight, most preferably being 100% to 125% of the neat silicate solution weight for spray application, and 175% to 200% for immersion application.

Optionally, penetration of the aqueous sealing solution may be additionally facilitated if required or desired on substrates with certain porosities, by inclusion of a wetting agent. Although not specifically necessary in the preferred embodiment, addition of the wetting agent can be typically one of or a blend of a number of proprietary commercial wetting polymers added in the range of 0.0005 parts per hundred to 0.05 parts per hundred by weight of the neat solution weight, and most preferably 0.001 parts by weight of the neat silicate solution weight. Such wetting polymers can be selected on the basis of their stability in and compatibility with alkaline solutions containing alkali metal silicates, and may facilitate application and absorption. The water dilution and the wetting agents modify the neat silicate blend and facilitate penetration of the sealing solution into the porous substrate of the powdered metal and cast metal components.

Further, the aqueous sealing solution may require rheological modification for specific spray or immersion application. A number of standard rheological additives utilized in paints and coatings can be employed to attain desired flow characteristics respective to the requirements of the application method selected, such as spray, immersion or centrifugal. Rheological modifiers can be inorganic like mica or clay, or organic long chain cellulosic polymers, and are typically added from 0.1 parts per hundred to 5.0 parts per hundred by weight of the neat sealing solution weight.

The wetting and theological agents reduce surface tension of the solution to facilitate penetration into the porous substrate of the components.

Because the dilute aqueous sealing solution is water clear and near water-like in viscosity, for identification purposes or safety concerns dyes can be added to the aqueous solution to tint the solution to a desired color and shade for ease of identification. The selected dyes must be water dispersable, colorfast and stable in alkaline solutions ranging in pH from 8.0 to 12.0, and since they are added to achieve the desired coloration effect visible to the unaided eye in typical concentrations ranging from 0.00001 parts to 0.01 parts per hundred by weight on the neat silicate solution weight, no specific quantity is preferred.

It also may be desired to impart a certain degree of flexibility to the rigid cured silicate matrix to limit the amount of microfracture during machining. A typical water miscible plasticizer is a waterborne acrylic latex emulsion that is stable in alkaline environments, and is added in a range from 0.1 parts to 10 parts per hundred by weight of the neat silicate solution weight, most preferably 5 parts per hundred. Preferred plasticizers may be polymers or copolymers of acrylic, styrene, butadiene resin monomers, or combinations thereof.

Functional pigments may be included as modifiers to the aqueous sealing solution to impart additional desired properties, including yet more effective sealing of very low density powdered metal components, conductivity, or machineability. These pigments may include finely divided metallic powders or dusts, such as zinc, tin, aluminum, stainless steel, etc., for improved porosity reduction, corrosion resistance, or improved conductivity of the cured glass-like silicate matrix. Other non-metallic pigments that can be effective in porosity reduction or improved receptivity of subsequently applied functional surface treatments are clay, talc, wollastonite, titanium dioxide, aluminum oxide, alumina trihydrate, zirconium dioxide, potassium zirconium carbonate, mica, etc. Functional pigments like inorganic molybdenum disulfide, emulsified waxes, or organic chlorofluorinated polymers like polytetrafluoroethylene are known effective friction reducing agents that provide the sealed component with desired lubricity or machineability. Ceramic microspheres fabricated of silicates and borosilicates may be included as modifiers to the aqueous sealing solution to impart more effective sealing of porosity in very low density powdered metal components of less than 6.4 grams per cubic centimeter or less. For porous metallic substrates that may be subject to secondary operations that include welding and be treated with the present invention for porosity reduction, the inclusion of one or more iron phosphide or polyphosphide compounds will promote weldability. These functional pigments can be added in a range from 0.5 parts per hundred by weight to 30 parts per hundred by weight of the neat silicate solution weight depending on the application, the substrate, and the desired effects.

The aqueous solution containing the dilute silicate blend, dilution water, wetting agent, plasticizer (if desired), dyes (if desired), and non-reactive functional pigments (ex: PTFE, microspheres, clay, wax, aluminum oxide, molybdenum disulfide) can be stored at room temperature indefinitely. Reactive metallic pigments such as zinc and aluminum dust, flake, or powder may require packaging separately from the aqueous sealing solution and be combined in preferred amounts prior to use.

Referring to the process flow diagram shown in the drawing, the parts are first cleaned to remove dirt and hydrophobes at station 10 before application of the aqueous sealing solution which is mixed at station 12 from the desired ingredients for the particular parts. The porous components to be treated must be clean and free of dirt, oil, machining lubricants, sizing die lubricants, and other hydrophobic materials. Suitable pretreatment processes depend on the metal comprising the substrate and include thermal or vapor degreasing, alkaline cleaning, acid cleaning, abrasive cleaning, or combinations thereof.

It is desired that the porous components to be treated with the aqueous sealing solution be of uniform temperature in a range from 80° F. to 150° F., most preferably from 100° F. to 120° F. prior to introduction of the aqueous sealing solution. Depending on upstream processes, the components to be treated may require cooling or heating. Alternatively, the aqueous sealing solution may be heated to the desired temperature range.

The aqueous sealing solution can be applied by spray, immersion, immersion with mechanical agitation, immersion with ultrasonic agitation, immersion with vacuum assist, dip-drain, dip-spin, or any other suitable method. Preferably, the solution is applied by spray, immersion, or dip-spin or dip-drain, and most preferably by spray or dip-drain in a continuous process such as that afforded by a conveyor apparatus. This application may be performed in 20 to 300 seconds.

The components requiring sealing must dwell in the spray or immersion bath such that the desired amount of aqueous sealing solution is absorbed. The dwell time is preferably 45 to 60 seconds for spray application and from 90 to 120 seconds for immersion, depending on part porosity. If the chosen application is by spray, the parts will go from the cleaning station 10 to the application station 14A, and if by immersion, to the application station 14B.

It is desired to control the temperature of the aqueous sealing solution to be in a range from 60° F. to 90° F., most preferably 75° F., if the parts are to be heated. If part heating is not possible, the temperature of the aqueous sealing solution can be controlled, preferably from 100° F. to 120° F.

The desired amount of dry, cured, aqueous sealing solution is desirably from 1.0 grams per square foot of treated surface to 14.0 grams per square foot of treated surface, and desirably from 5.0 to 9.0 grams per square foot of treated surface, and most preferably about 6.0 to 8.0 grams per square foot of treated surface. The number of spray nozzles or the dwell time or number of individual coats in the immersion bath is adjusted accordingly.

Following application of the aqueous sealing solution by preferably spray or immnersion, the parts are conveyed to the station 16 for the parts to be subjected to still air for about 60 to 240 seconds so that the solution is further allowed to absorb into the substrate while excess is drained off. Thereafter, the parts are conveyed to station 18 for about 20 to 600 seconds where preferably high velocity air knife removal of excess aqueous sealing solution or heat evaporation of same takes place. It is most preferred that air knife removal of excess aqueous sealing solution be employed in order to ensure that excess solution is removed from component features that would tend to trap or hold any excess. The parts are next allowed to briefly dwell in still air for 10 to 60 seconds when advanced to station 20.

Following the dwell in still air at station 20, the components are conveyed to a curing station for curing the silicate matrix. The matrix may be cured by heat, application of an acid, or at ambient temperature by air if a lithium silica sol is added to the blend of silicates.

When cured by heat, the sealed components are then introduced to a source of heat in order that the part surface temperature is raised to a range from 125° F. to 400° F. with a dwell time range of 30 to 300 seconds in order to evaporate moisture and effect a cure of the silicate matrix. This step requires the components to be conveyed to station 22C. The silicate matrix is cured by evaporative removal of the free water of the solution and some of the bound water of the silicates so that the silicate matrix is not readily soluble and preferably insoluble, forming silicon dioxide. The preferred part surface temperature is approximately 300° F. to 350° F. for approximately 60 to 180 seconds, although the silicate matrix can be cured as high as 700° F. for approximately 30 seconds. The heat source at station 22C can be either electrically or fossil fuel fired and contained in an insulated oven of appropriate dimensions for the components to be cured, it being appreciated that the length and thermal capacity of the heated oven would be sized to the throughput of the components being processed such that the preferred cure temperature can be reached at the desired production rate. These factors are dependent on the size and mass of the components to be processed. Then the parts are conveyed to station 24C and subjected from 90 to 500 seconds to cooling by forced convection, and finally inspected, tested, and packed at station 28.

Alternatively, curing of the components at ambient temperature is possible by inclusion of lithium silica sol in the silicate blend. Then the components would be conveyed from station 20 to a station along the conveyer ahead of the inspection station 28 where adequate time in the air at ambient temperature would result in curing the matrix.

When curing the silicate matrix on the parts by an acid, the parts are conveyed from station 20 to station 22D where the parts are subjected to a dilute acidic solution for a period of about 10 to 120 seconds. Preferably, phosphoric acid or orthophosphoric acid at a concentration from 5% to 25%, and most preferably at about 10% is used. The parts are next subjected to a neutral pH filtered water rinse at station 24D. The acid rinse temperature is preferably from 100° F. to 150° F., and most preferably at 115° F. to 125° F. and for about 10 to 60 seconds.

Application of the acid at station 22D can be by spray, immersion, immersion with mechanical agitation, immersion with ultrasonic agitation, immersion with vacuum assist, dip-drain, or dip-spin, and preferably by spray or immersion. The silicate matrix readily gels in the presence of an acid or a carbon dioxide atmosphere as the alkali in the silicate is neutralized. The silicate gel is insoluble following its formation. Suitable process controls are employed to ensure that the acid concentration is held within specifications. Thereafter, the sealed parts are dried by forced convection from 10 to 300 seconds at station 24 and finally inspected, tested, and packed at station 28, for transfer to subsequent plating, coating or machining operations.

Multiple applications of the aqueous sealing solution can be applied in stages to achieve the preferred applied amount of aqueous sealing solution. Each stage would consist of the process described above, entailing application, absorption, removal of excess, and cure of the aqueous sealing solution.

The following examples illustrate the invention. All quantities are in parts per hundred by weight.

EXAMPLE A

An aqueous sealing solution prepared as follows was evaluated on a sintered iron powdered metal component subsequently treated with the application of a corrosion resistance coating and evaluated in ASTM B-117 Neutral Salt Spray for corrosion resistance performance:

36 parts 2.00 weight ratio sodium silicate 24 parts 3.22 weight ratio sodium silicate 40 parts 2.50 weight ratio potassium silicate The above components are mixed with low shear yielding a 100 part basis formulation to which is added:

0.3 parts xanthan gum dispersed in 100 parts filtered, deionized water along with 0.005 parts Triton X-100 wetting agent.

Once added to the basis formulation, the diluted surfactant and the dilution water and silicate basis formulation is mixed for 10 to 20 minutes with low shear mixing to yield a homogeneous mixture.

The mixture was spray applied in three coats to the iron powdered metal component which was preheated to a surface temperature of 100° F., applied such that the surface of the part was evenly wetted without runs, sags, or other concentrations. The sealing solution was allowed to be absorbed into the component until the surface appeared dry, approximately 30 to 60 seconds. The aqueous sealing solution so applied yielded a mass sealer weight gain of 6.4 grams per square foot of treated surface. The sealer was cured at 350° F. PMT for 180 seconds. After application and cure of the sealer coat, the corrosion resistance coating was applied to the sealed substrate to a mass weight from 2200 milligrams per square foot to 2600 milligrams per square foot as determined by the weight-coat-weigh method. The coating was applied at the same time in the same mass weight range to identical components not treated with the aqueous sealing solution described above and to identical components that were sealed by steam treating as a control. Following appears the ASTM B-117 Neutral Salt Spray test results:

| Sealing Method | ASTM B-117 NSS (Hours to red rust appearance) |
|---|---|
| None | 24 |
| Steam Treated | 672 |
| Aqueous Solution above | 1296 |

EXAMPLE B

An aqueous sealing solution prepared as follows was evaluated on a sintered iron powdered metal component subsequently treated with application of a corrosion resistance coating and evaluated in ASTM B-117 Neutral Salt Spray for corrosion resistance performance:

25 parts 2.00 weight ratio sodium silicate 15 parts 3.22 weight ratio sodium silicate 60 parts 2.50 weight ratio potassium silicate The above components are mixed with low shear yielding a 100 part basis formulation to which is added:

0.005 parts wetting agent diluted in 100 parts filtered deionized water Once added to the basis formulation, the diluted surfactant and the dilution water and silicate basis formulation is mixed for 10 to 20 minutes with low shear mixing to yield a homogeneous mixture.

The mixture was spray applied to the iron powdered metal component which was preheated to a surface temperature of 100° F., applied such that the surface of the part was evenly wetted without runs, sags, or other concentrations. The aqueous sealing solution was allowed to absorb into the component until the surface appeared dry, approximately 30 to 60 seconds. The aqueous sealing solution so applied yielded a mass sealer weight gain of 4.1 grams per square foot of treated surface. The sealer was cured at 350° F. PMT for 180 seconds. After application and cure of the sealer coat, the corrosion resistance coating was applied to the sealed substrate to a mass weight from 2200 milligrams per square foot to 2600 milligrams per square foot as determined by the weight-coat-weigh method. The coating was applied at the same time in the same mass weight range to identical components not treated with the aqueous sealing solution described above and to identical components that were sealed by steam-treating as a control. Following appears the ASTM B-117 Neutral Salt Spray test results:

| Sealing Method | ASTM B-117 NSS (Hours to red rust appearance) |
|---|---|
| None | 24 |
| Steam Treated | 696 |
| Aqueous Solution above | 744 |

EXAMPLE C

An aqueous sealing solution prepared as follows was evaluated on a sintered iron powdered metal component subsequently treated with application of a corrosion resistance coating and evaluated in ASTM B-117 Neutral Salt Spray for corrosion resistance performance:

36 parts 2.00 weight ratio sodium silicate 24 parts 3.22 weight ratio sodium silicate 40 parts 2.50 weight ratio potassium silicate The above components are mixed with low shear yielding a 100 part basis formulation to which is added:

0.005 parts wetting agent diluted in 100 parts filtered deionized water Once added to the basis formulation, the diluted surfactant and the dilution water and silicate basis formulation is mixed for 10 to 20 minutes with low shear mixing to yield a homogeneous mixture.

The mixture was applied by immersion without vacuum assist to the iron powdered metal component which was preheated to a surface temperature of 100° F. The sealing solution was allowed to be absorbed into the component for 300 seconds, and the component was removed from the sealing solution bath. The component was allowed to drain in ambient still air for 60 seconds, followed by a blast of high velocity air to remove excess sealer material. The aqueous sealing solution so applied yielded a mass sealer weight gain of averaging 7.2 grams per square foot of treated surface. The sealer was cured at 350° F. PMT for 180 seconds. After application and cure of the sealer coat, the corrosion resistance coating was applied to the sealed substrate to a mass weight from 2200 milligrams per square foot to 2600 milligrams per square foot as determined by the weight-coat-weigh method. The coating was applied at the same time in the same mass weight range to identical components not treated with the aqueous sealing solution described above and to identical components that were sealed by steam-treating as a control. Following appears the ASTM B-117 Neutral Salt Spray test results:

| Sealing Method | ASTM B-117 NSS (Hours to red rust appearance) |
|---|---|
| None | 24 |
| Steam Treated | 624 |
| Aqueous Solution above | 912 |

From the foregoing, it will be appreciated that the porosity reducing solution and process applying the solution to porous metal components according to the present invention materially improves the effectiveness of subsequently applied functional or performance coatings and the machineability of the components.

It will be understood that modifications and variations may be effected without departing from the scope of the novel concepts of the present invention, but it is understood that this application is to be limited only by the scope of the appended claims.

The invention is hereby claimed as follows:

1. A method of reducing and sealing the porosity of sintered powdered metal or cast liquid metal parts without altering the metallurgical properties of the parts so that the subsequent application and performance of functional surface treatments or performance coatings is effective which comprises the steps of:

cleaning the metal parts, and sequentially applying a solution of aqueous inorganic silicates to the surfaces of the parts, wherein the aqueous inorganic silicates include 5 to 50 parts 2.00 weight ratio aqueous sodium silicate solution, 5 to 50 parts 3.22 weight ratio aqueous sodium silicate solution, and 20 to 90 parts 2.50 weight ratio potassium silicate solution, allowing absorption of the solution into the parts, removal of excess solution, exposing the parts to air, and curing the silicates.

2. The method of claim 1, wherein the silicates include metal ions taken from Group 1A elements.

3. The method of claim 1, wherein the aqueous inorganic silicates include 36 parts 2.00 weight ratio aqueous sodium silicate solution, 24 parts 3.22 weight ratio aqueous sodium silicate solution, and 40 parts 2.50 weight ratio aqueous sodium potassium silicate solution.

4. The method of claim 1, wherein the step of applying the solution includes immersing the parts into the solution with or without mechanical or ultrasonic agitation, or vacuum assist, followed by a heated water rinse, air blast removal of excess solution, and drying.

5. The method of claim 1, wherein the step of applying the solution includes spraying the solution onto the parts, followed by heated water rinsing, air blast removal of excess solution, and oven drying.

6. The method of claim 1, wherein the step of applying the solution includes dipping, dip-spinning, or dip/draining the parts in the solution, with or without vacuum assist, followed by heated water rinsing, air blast removal of excess solution, and oven drying.

7. The method of claim 1, wherein the step of curing comprises:

applying heat to the parts such that the surfaces of the parts reach 125–400° F.

8. The method of claim 1, wherein the step of curing comprises:

applying a mild acidic aqueous solution to the parts by spray, immersion, immersion with mechanical or ultrasonic agitation, immersion with vacuum assist, dip-drain or dip-spin followed by a warm water rinse and drying.

9. The method of claim 8, wherein the mild acidic solution is phosphoric acid diluted in water to a concentration from 5 to 25 percent.

10. The method of claim 1, wherein the solution further includes a lithium silicate sol having a weight ratio of silicate to alkali expressed as $SiO_2$:$Li_2$ of about 10.0, and the step of curing includes subjecting the parts to ambient temperature.

11. The method of claim 1, wherein the solution further includes a wetting agent to facilitate the absorption of the solution into the part.

12. The method of claim 1, wherein the solution further includes a rheological modifier to attain a desired flow characteristic.

13. The method of claim 1, wherein the solution further includes a dye to facilitate identification.

14. The method of claim 1, wherein the solution further includes a plasticizer to impart flexibility to the cured silicate.

15. The method of claim 1, wherein the solution further includes a non-reactive functional pigment to facilitate lubricity and/or machinability and/or weldability.

16. The method of claim 1, wherein the solution further includes a wetting agent to facilitate the absorption of the solution into the part, a rheological modifier to attain a desired flow characteristic, a dye to facilitate identification, a plasticizer to impart flexibility to the cured silicate, and a non-reactive functional pigment to facilitate lubricity and/or machinability and/or weldability.

* * * * *